US006932675B1

(12) United States Patent
Bremer et al.

(10) Patent No.: US 6,932,675 B1
(45) Date of Patent: Aug. 23, 2005

(54) PLATED GRINDING WHEEL LIFE MAXIMIZATION METHOD

(75) Inventors: Shane E. Bremer, Hope, MI (US); Scott A. Hucker, Ortonville, MI (US); Philip E. Burgess, Columbia, TN (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/771,842

(22) Filed: Feb. 4, 2004

(51) Int. Cl.[7] ..... B24B 49/00
(52) U.S. Cl. ..... 451/8; 451/28; 451/42
(58) Field of Search ..... 451/8, 1–7, 9–10, 451/41, 28, 42–44, 435, 443, 548

(56) References Cited

U.S. PATENT DOCUMENTS 4,590,573 A * 5/1986 Hahn ..... 700/164
5,782,674 A * 7/1998 Hahn ..... 451/9
6,602,109 B1 * 8/2003 Malkin et al. ..... 451/8
2003/0194946 A1 * 10/2003 Malkin et al. ..... 451/8

* cited by examiner

*Primary Examiner*—Lee D. Wilson
(74) *Attorney, Agent, or Firm*—Leslie C. Hodges

(57) ABSTRACT

A method of determining the condition of a grinding wheel is provided to avoid over use or premature changing of the grinding wheel in a grinding machine, such as for crankshaft or camshaft grinding. The grinding machine has a motor which drives a grinding spindle carrying an abrasive coated hub acting as a grinding wheel. Sensors detect the level of grinding force and motor torque required to grind a workpiece into a desired shape. The information is relayed to a controller, which averages and compares the grinding force and torque information to force and torque limits to determine the condition of the wheel. In addition, the controller compares grinding force and motor torque over a series of grinds to determine the level of increase between grinds to further determine the condition of the grinding wheel. If the level of increase exceeds an increase limit, the controller actuates a fault signal to stop the grinding machine indicating that the wheel is near the end of its life cycle.

16 Claims, 3 Drawing Sheets

PLATED GRINDING WHEEL LIFE MAXIMIZATION METHOD

TECHNICAL FIELD

This invention relates to grinding machines and, more particularly, to methods of determining the condition of an electroplated grinding wheel to indicate when a grinding wheel is near the end of its life cycle.

BACKGROUND OF THE INVENTION

Grinding machines for grinding camshafts and crankshafts are known in the art. For rough grinding, such a machine may use a grinding wheel spindle having a steel hub, onto which a single layer of cubic boron nitride (CBN) grains are held by an electroplated layer of material such as nickel to provide a grinding wheel with a grinding surface around the circumference of the wheel.

Over the life of the wheel, the grains are worn down and the nickel layer is eroded. This is a gentle and slowly-evolving condition during the life of the wheel. However, at some point, damage to the bonding layer becomes catastrophic, resulting in grain loss. This then transfers more of the cutting load to the remaining active grains. Rapidly, grains are stripped, causing failure of the grinding surface, and rubbing between the metal wheel hub and workpieces takes place producing extremely high forces on the grinding spindle bearing system. If continued, the additional grinding may overload the grinding motor and/or damage the grinding wheel spindle. In order to avoid spindle damage and motor overload, grinding wheels are prematurely replaced after a set number of grinds. Consequently, grinding wheels which may still be usable are prematurely replaced, resulting in increased manufacturing costs.

A method of determining when a grinding wheel is near the end of its life cycle is desired to prevent excessive grinding machine wear or damage while avoiding premature replacement of usable grinding wheels.

SUMMARY OF THE INVENTION

The present invention provides a method of determining the condition of a grinding wheel during grinder operation to avoid over use or premature replacement of the grinding wheel.

A grinding machine designed for grinding of camshafts, crankshafts or other workpieces may include an electric motor, which drives a rough grinding spindle having a steel hub. The hub periphery preferably carries a single layer of cubic boron nitride (CBN) grains held in place by an electroplated material such as nickel. The grinding machine is adapted to rotate a workpiece, such as a camshaft or crankshaft, adjacent the grinding wheel.

Sensors positioned within the grinding machine monitor motor torque, spindle speed, grinding force and grinding position. The sensors relay information to a controller, which controls movement of the grinding wheel and records periodic readings of the grinding force applied during grinding of a workpiece into a desired shape.

The controller calculates and records an average of the grinding force readings during a selected portion of the grind of each workpiece to determine an average of the recorded grinding force for each part. The controller may also monitor the motor torque applied during grinding and determine an average of recorded motor torque for a selected portion of the grind of each workpiece.

If the average of recorded grinding force or the average of recorded motor torque exceeds a predetermined grinding force or motor torque limit, the controller actuates a fault signal to stop the grinding machine, indicating the grinding wheel is near the end of its life cycle. The worn grinding wheel can then be replaced.

When the averages of recorded grinding force readings or the average of recorded motor torque readings do not exceed the predetermined grinding force or motor torque limits, the controller will allow the grinding machine to perform subsequent grinds, until the controller determines the grinding wheel is near the end of its life cycle.

During successive grinds, the controller continues to calculate the average of recorded grinding force readings and the average of recorded motor torque readings for the selected portions of each grind. The average of recorded grinding force readings and average of recorded motor torque readings from the current grind is compared to the average of these readings of the previous grind to quantify an incremental increase in average grinding force readings and average motor torque readings from one grind to the next. The level of increase is then compared to a predetermined limit of grinding force increase and a predetermined limit of motor torque increase. If the increase exceeds either limit, the controller will actuate a fault signal and stop the grinding machine and allow the spent grinding wheel to be replaced. This prevents damage caused by continued operation. If the increase does not exceed the limits, the controller will allow the grinding machine to continue the current operations.

These and other features and advantages of the invention will be more fully understood from the following description of certain specific embodiments of the invention taken together with the accompanying drawings.

DESCRIPTION OF THE PREFERRED EMBODIMENT

Figure 1:
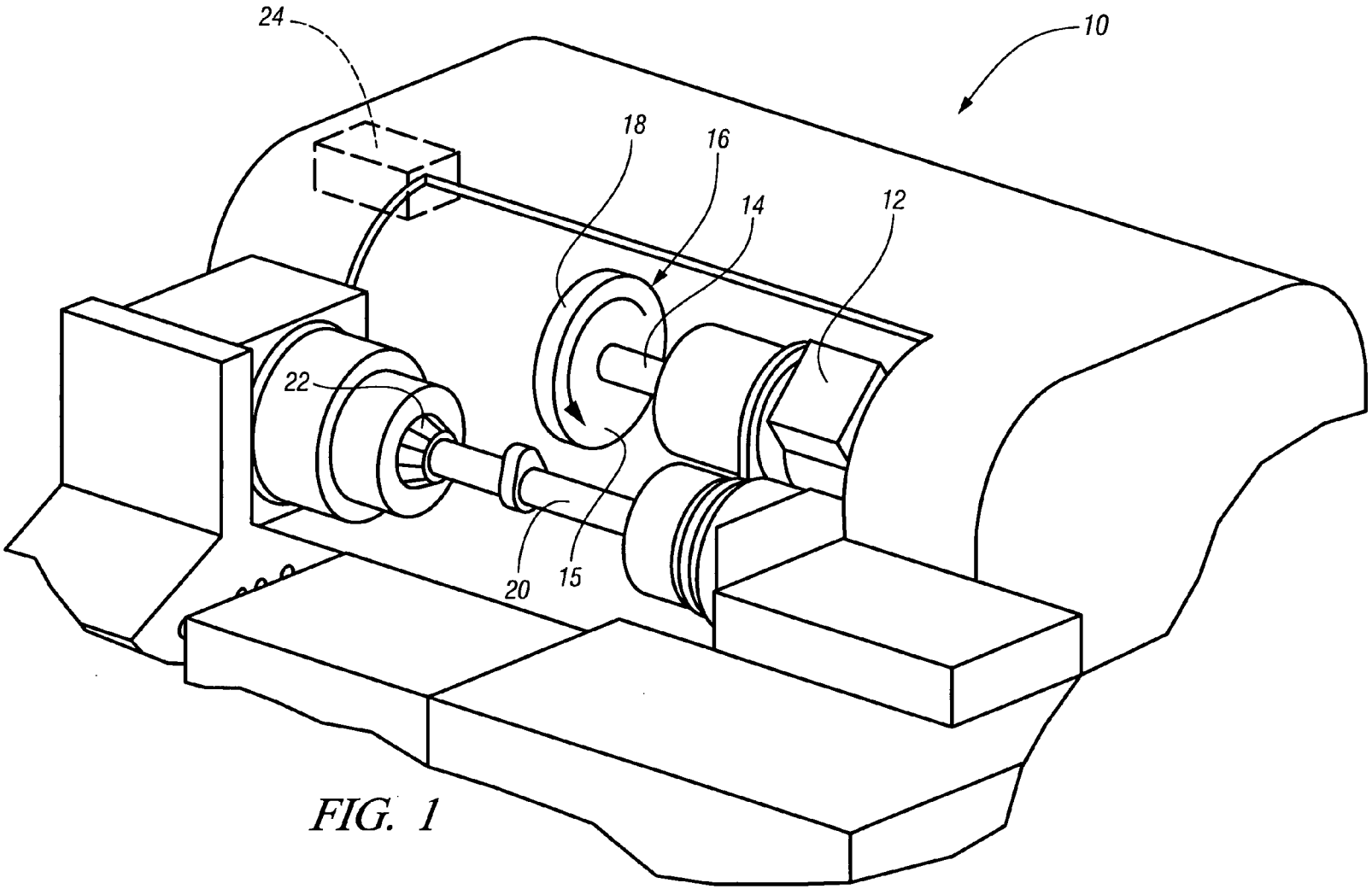
FIG. 1 is a simplified view of an exemplary grinding machine for use in camshaft rough grinding.

Referring now to FIG. 1 of the drawings in detail, numeral 10 generally indicates a grinding machine for use in camshaft rough grinding, as well as other grinding functions. The grinding machine 10 has a motor 12, which drives a grinding spindle 14 carrying a hub 15. An outer periphery of the hub is covered by a single layer 18 of cubic boron nitride (CBN) grains which are held to the periphery of the hub 15 by electroplating thereon a material such as nickel, thus forming a grinding wheel 16. The single layer of CBN provides grinding or cutting edges which enable the grinding wheel 16 to grind steel, cast iron, or other hard substances.

The grinding machine 10 is adapted to rotate a workpiece 20, such as a camshaft or crankshaft, in a rotatable chuck 22 adjacent the grinding wheel 16. If desired, multiple grinding wheels similar to grinding wheel 16 may be carried by the grinding spindle 14 to enable the grinding machine 10 to simultaneously grind multiple surfaces of a workpiece.

Coolant nozzles, not shown, may direct coolant against the grinding interface to carry away heat and grinding particles from the grinding interface.

Sensors, not shown, within the grinding machine 10 monitor motor torque, spindle speed, grinding force and grinding position and relay the information to a controller 24. The controller 24 controls the movement of the grinding wheel 16 and monitors the condition of the grinding wheel 16 using information relayed from the sensors.

According to the present invention, the controller 24 determines the condition of the grinding wheel 16 using the level of grinding force between the wheel 16 and a workpiece during grinding of a workpiece into a desired shape. If desired, the controller 24 may also use the level of motor torque reached. When either the level of grinding force or the level of motor torque exceeds predetermined limits, specific to the grinding machine 10, the controller actuates a fault signal to stop the grinding machine, to allow the worn grinding wheel 16 to be replaced.

Referring now to the operation of the controller 24 in further detail, the controller 24 operates by first monitoring and recording the level of grinding force applied by the grinding wheel 16 at a series of time intervals during a selected portion of a workpiece grind, such as a final plunge cut during one rotation of the workpiece. The recorded grinding forces are then averaged to create an average of recorded grinding forces, which is then compared to a grinding force limit.

The grinding force limit is predetermined and established by engineers based on the type of grinding machine, the type of grinding wheel and the material of the workpiece. Using grinding machine 10 as an example, the grinding force limit is established to be around 16 percent of the maximum force capability of the grinding machine 10. The force limit is calculated by adding 10 percent of the force capability of the grinding machine to the average level of grinding force of a typical workpiece with an unused grinding wheel. If the average of recorded grinding force exceeds the force limit, the controller 24 will actuate a fault signal to stop the grinding machine 10, to allow the worn grinding wheel 16 to be replaced.

If desired, the controller 24 may use motor torque to provide a second method of monitoring the condition of the wheel 16. The controller 24 monitors and records periodic readings of motor torque exerted by the wheel drive motor 12 over a period of time, such as a final plunge cut during one rotation of the workpiece 20. The readings of recorded motor torque are then averaged to create an average of recorded motor torque, which is then compared to a motor torque limit. The motor torque limit is predetermined and established by engineers based on the type of grinding machine, the type of grinding wheel and the material of the workpiece.

Using grinding machine 10 as an example, the motor torque limit is established to be around 40 percent of the maximum torque capacity of the grinding wheel drive motor 12. The motor torque limit is calculated by adding 10 percent of the drive motor torque capability to the average motor torque exerted when a typical workpiece is ground with an unused grinding wheel. If the average motor torque exceeds the torque limit, the controller 24 actuates a fault signal to stop the grinding machine, to allow the worn grinding wheel 16 to be replaced.

The controller 24 continues to determine the average of recorded grinding force during subsequent grinds of subsequent workpieces to create an average of recorded grinding force for each grind or workpiece. The average of recorded grinding force from a current grind is then compared to the previous average of recorded grinding force from a previous grind or a previous workpiece to quantify an incremental increase in the average of recorded grinding force from one grind or workpiece to the next. The increase is then compared to a predetermined grind force increase limit, which is predetermined and established by engineers based on the type of grinding machine, the type of grinding wheel and the material of the workpiece.

Using grinding machine 10 as an example, the force increase limit is established to be 40 percent greater than the average of recorded grinding force of the previous grind or workpiece. Therefore, if the previous average or recorded grinding force is 5% of the force capacity of the grinding machine, an increase of up to 2% would be allowable (40% of 5%=2%). If the level of increase exceeds 2%, then the controller 24 actuates a fault signal to stop the grinding machine 10, to allow the worn grinding wheel 16 to be replaced.

If the increase is below 2%, the controller proceeds to compare the average of recorded grinding force of the current grind to the grinding force limit. If the average or recorded grinding force exceeds the grinding force limit, the controller actuates a fault signal to stop the machine to allow the worn grinding wheel to be replaced.

The controller 24 may also record and average the level of motor torque during subsequent grinds or subsequent workpieces to create an average of recorded motor torque for each grind or workpiece. The average or recorded motor torque from the current grind is then compared to the previous average of recorded motor torque to quantify an incremental increase in the average of recorded motor torque from one grind or workpiece to the next. The level of increase is then compared to a motor torque increase limit, which is predetermined and established by the type of grinding machine, the type of grinding wheel and the material of the workpiece.

Using grinding machine 10 as an example, the torque increase limit between the successive grinds or workpieces is established to be 40% greater than the average of recorded grinding force of the previous grind or workpiece. Therefore, if the previous average of recorded motor torque value is approximately 30% of the capacity of the grinding machine, a change of up to 12% would be allowable (40% of 30%=12%). If the level of increase exceeds 12%, then the controller 24 actuates a fault signal to stop the grinding machine 10 to allow the worn grinding wheel 16 to be replaced.

If the increase is below 12%, the controller proceeds to compare the average of recorded motor torque, from the current grind, to the motor torque limit to see if the current motor torque average exceeds the torque limit, indicating a failed grinding wheel. If the average of recorded motor torque exceeds the motor torque limit, the controller actuates a fault signal to stop the grinding machine to allow the worn grinding wheel to be replaced.

In operation, an unfinished cast workpiece 20, such as a camshaft, is rotated by the grinding machine 10 adjacent the grinding wheel 16. Once the workpiece 20 is securely retained within the chuck 22 of the grinding machine 10, the grinding wheel 16 is brought up to optimal grinding speed. The grinding wheel 16 is then advanced toward the workpiece 20. As the grinding wheel makes contact with the workpiece, the workpiece is rotated to allow the wheel to grind away any imperfections on the surface of the workpiece. During this time, cooling solution is sprayed on the grinding interface to carry away heat from the grinding process. Depending on the workpiece and the type of grinding wheel, it may require multiple plunge cuts, at multiple depths, to grind the workpiece into a desired shape and to provide a machined surface.

As the grinding wheel 16 grinds the surface of the workpiece 20, motor torque and grinding force information are relayed to the controller 24. The information is then averaged and compared to motor torque and grind force limits stored within the controller 24, as previously described, to determine the condition of the wheel 16. As subsequent workpieces 20 are ground in the same manner as described above, the motor torque and grind force information from the subsequent grind are averaged and recorded. The recorded grind force and motor torque are then compared to the previous grind to quantify the increase as previously described. The increase of grinding force and motor torque are then compared to increase limits, to determine the condition of the wheel 16, as previously described.

Figure 2:
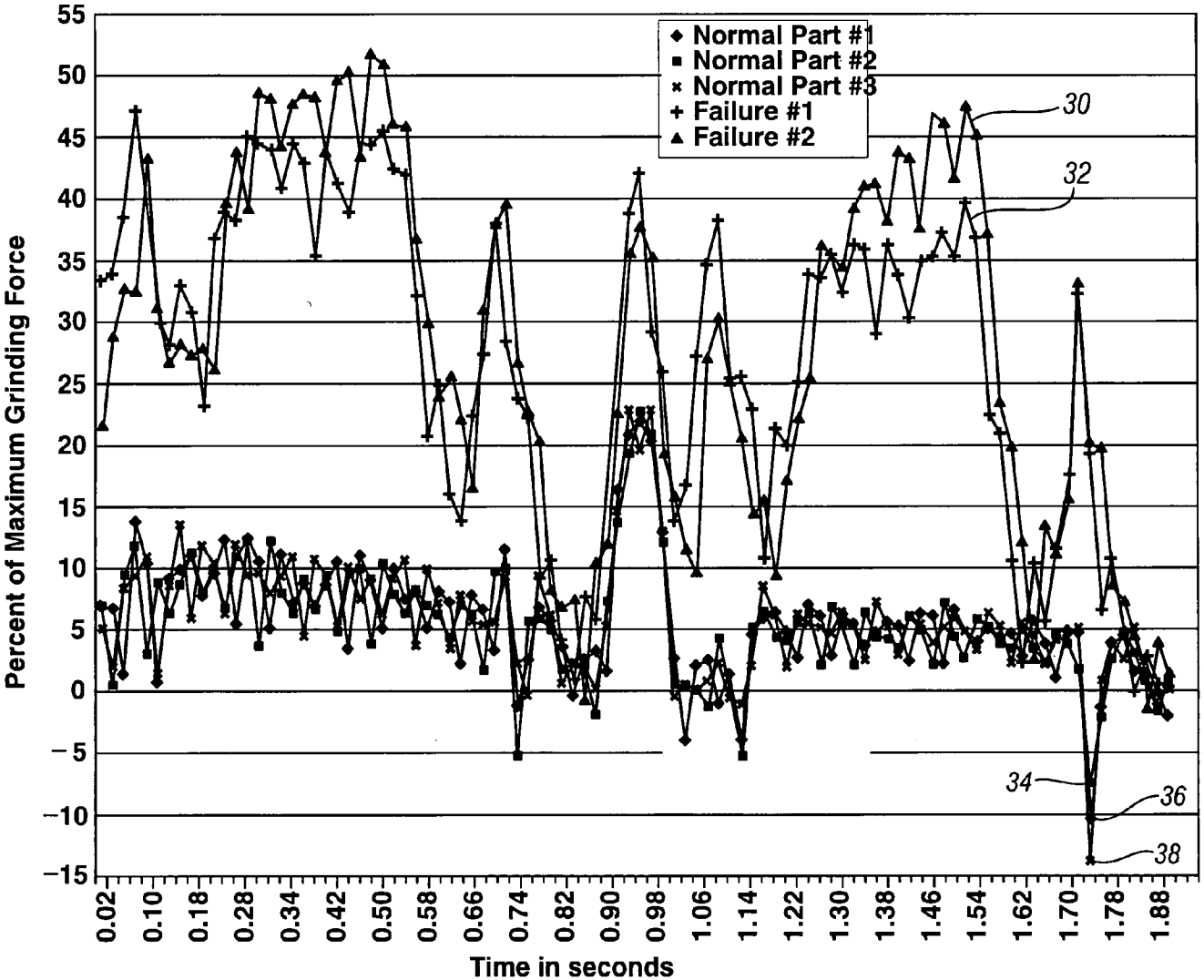
FIG. 2 is a graph of drive force readings versus time intervals for the last plunge of a rough grinding process on a machine similar to FIG. 1.

FIG. 2 is a graph comparing wheelhead forces of three normal wheels and two failed wheels operating in the grinding machine 10. The results show that failed grinding wheels, represented by lines 30, 32 utilized an average of about 28% of the grinding force capacity of the grinding machine. The good grinding wheels represented by lines 34, 36, 38 utilized an average of only about 5.5% of the grinding force capacity of the grinding machine. This shows that as the grinding wheel 16 nears the end of its useful life, prior to failure, the amount of grinding force begins to increase substantially. Accordingly, the controller 24 monitors the status of the grinding wheel 16 using grinding force loads in a manner to predict when a grinding wheel 16 is near the end of its life cycle, before the grinding wheel fails as illustrated by lines 30, 32.

Figure 3:
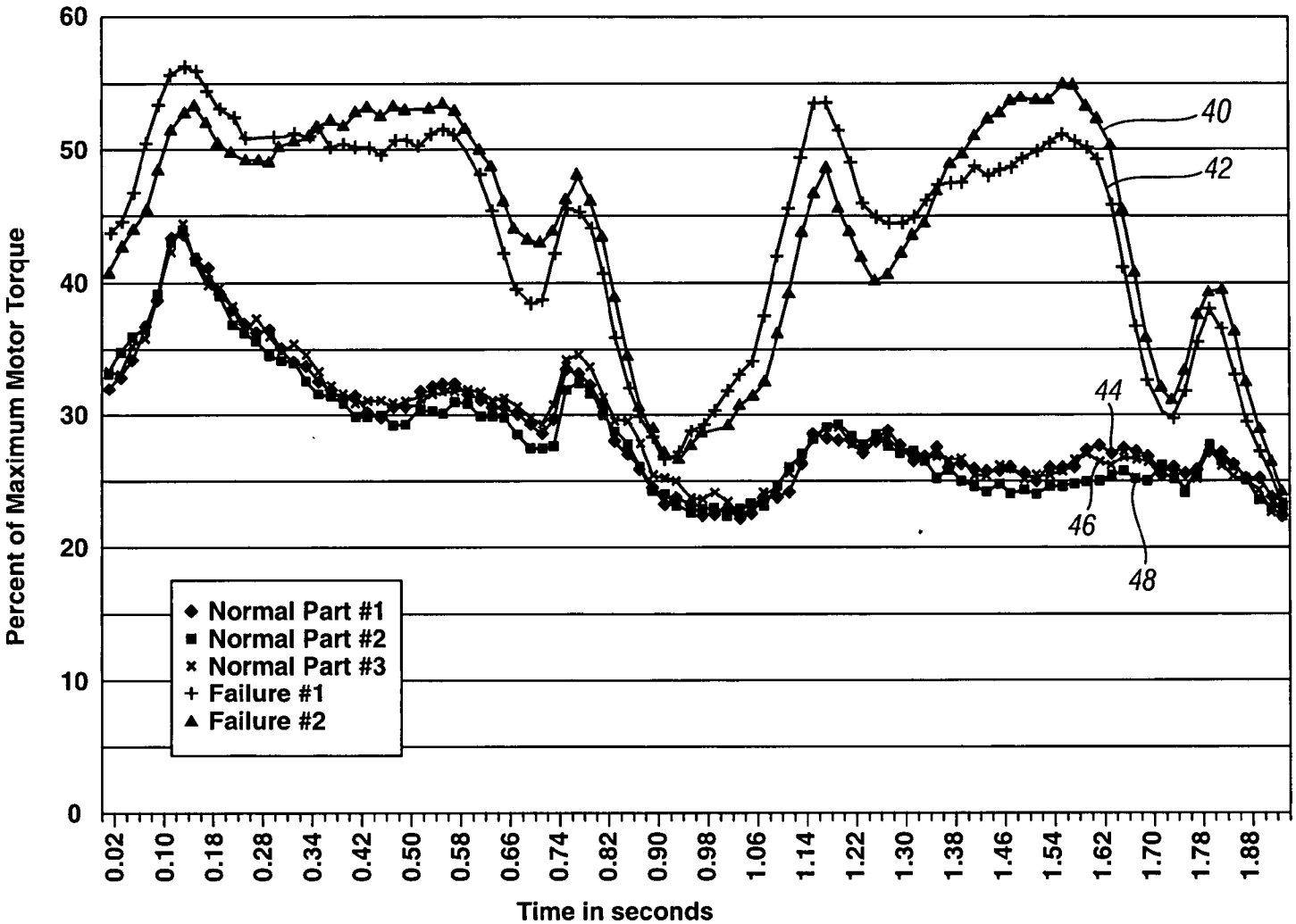
FIG. 3 is a graph of grinding motor torque versus time intervals for the last plunge of a rough grinding process similar to FIG. 2.

FIG. 3 of the drawings is a graph comparing motor torque for three normal wheels and two failed wheels operating in grinding machine 10. The results show that failed grinding wheels, represented by lines 40, 42, utilized an average of about 43% of the motor torque capacity of the grinding machine 10. The good grinding wheels, represented by lines 44, 46, 48, utilized an average of about 29% of the motor torque capacity of the grinding machine 10. Accordingly, the controller 24 monitors the status of a grinding wheel using motor torque to predict when the grinding wheel is near the end of its life cycle, before the grinding wheel 16 fails as illustrated by lines 40, 42.

It should be understood that by comparing the average of recorded grinding forces and the average of recorded motor torque from grind to grind or workpiece to workpiece, the controller 24 is able to detect a failed or near failed grinding wheel before the operating limits of the grinding machine 10 are reached.

In order to insure the most accurate results, the average recorded grinding force and average recorded motor torque should be compared at the same cycle or position for each workpiece 20 to ensure consistent results. Otherwise, the changes from cycle to cycle may cause the controller 24 to err and falsely stop the grinding machine 10. Preferably, the averaged grinding force and motor torque should be compared at the same plunge depth each time so that variations of the workpiece and other factors such as the aim of coolant nozzles and the level of coolant flow directed over the grinding wheel are consistent. At present, the last or second to last grind cycle or workpiece revolution has been found to be the most consistent from workpiece to workpiece. Therefore, the average grinding force and motor torque from these cycles provide the most accurate indices for control.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A method of determining the condition of an electroplated grinding wheel in a grinding machine having a grinding force sensor, while grinding a series of workpieces, the method comprising the steps of:

grinding successive workpieces with the grinding wheel and recording a series of readings of grinding force over selected portions of the grinding of the successive workpieces and relaying the grinding force information to a controller;

determining the averages of grinding forces recorded in said selected portions of the grinding of the successive workpieces;

comparing the averages of the recorded grinding forces of the successive workpieces to quantify an increase in average grinding force between selected portions of the grinding of the successively workpieces; and actuating a fault signal when the increase in average grinding force exceeds a predetermined force increase limit indicating that the grinding wheel is near the end of its life cycle.

2. The method as in claim 1 including comparing a predetermined grinding force limit with the average of recorded grinding forces of each selected portion of the grinding of the successive workpieces to determine if any of the compared averages exceeds the predetermined grinding force limit.

3. The method as in claim 2 including actuating the fault signal when any of the compared averages exceeds the predetermined grinding force limit indicating that the grinding wheel is near the end of its life cycle.

4. The method as in claim 2 wherein the grinding force limit is established by adding at least 10 percent of the force capability of the grinding machine to the average grinding force of a typical workpiece with an unused grinding wheel.

5. The method as in claim 1 wherein the selected portion of the grinding is during the last rotation of the workpiece.

6. The method as in claim 1 wherein the selected portion of the grinding is during the second to the last rotation of each workpiece.

7. The method as in claim 1 wherein the predetermined force increase limit is 40 percent greater than the average grinding force of an immediately preceding ground workpiece.

8. The method as in claim 1 including recording a series of readings of grinding motor torque over selected portions of the grinding of successive workpieces and relaying the grinding motor torque information to a controller.

9. The method as in claim 8 including determining the averages of grinding motor torque recorded in said selected portions of the grinding of the successive workpieces.

10. The method as in claim 9 including comparing the averages of the recorded grinding motor torque during the selected portion of the grinding of each of the successive workpieces to quantify an increase in average grinding motor torque between selected portions of the grinding of the successive workpieces.

11. The method as in claim 10 including actuating the fault signal when the increase in average grinding motor torque exceeds a predetermined motor torque limit indicating that the grinding wheel is near the end of its life cycle.

12. The method as in claim 11 wherein motor torque increase limit is 40 percent greater than the average motor torque of an immediately preceding ground workpiece.

13. The method as in claim 9 including comparing a predetermined motor torque limit with the average motor torque of each selected portion of the grinding of the successive workpieces to determine if any of the compared averages exceeds the predetermined motor torque limit.

14. The method as in claim 13 including actuating the fault signal when any of the compared averages of motor torque exceeds the predetermined motor torque limit indicating that the grinding wheel is near the end of its life cycle.

15. The method as in claim 14 wherein the motor torque limit is established by adding at least 10 percent of the motor torque capability of the grinding machine to the average motor torque of a typical workpiece with an unused grinding wheel.

16. The method as in claim 1 wherein actuating the fault signal stops the grinding machine.

* * * * *